US006845561B2

(12) United States Patent
Timson

(10) Patent No.: US 6,845,561 B2
(45) Date of Patent: Jan. 25, 2005

(54) REPLACEABLE-BLADE KNIFE

(75) Inventor: Todd A. Timson, Boulder, CO (US)

(73) Assignee: T&J LLC, Littleton, CO (US)

( * ) Notice: Subject to any disclaimer, the term of this patent is extended or adjusted under 35 U.S.C. 154(b) by 0 days.

(21) Appl. No.: 10/661,665

(22) Filed: Sep. 12, 2003

(65) Prior Publication Data

US 2004/0123468 A1 Jul. 1, 2004

Related U.S. Application Data

(60) Provisional application No. 60/410,525, filed on Sep. 13, 2002.

(51) Int. Cl.[7] ..... B26B 5/00
(52) U.S. Cl. ..... 30/125; 30/330; 30/339
(58) Field of Search ..... 30/124–125, 162, 30/330, 329, 337, 339, 332

(56) References Cited

U.S. PATENT DOCUMENTS

| | | | | | |
|---|---|---|---|---|---|
| 3,577,637 | A | | 5/1971 | Braginetz | |
| 3,593,417 | A | | 7/1971 | West et al. | |
| 3,604,113 | A | | 9/1971 | Cuscovitch | |
| 3,927,473 | A | | 12/1975 | Braginetz | |
| 4,068,375 | A | | 1/1978 | Rathbun et al. | |
| 4,604,805 | A | | 8/1986 | Krieger | |
| 5,174,028 | A | | 12/1992 | Seltzer, Jr. | |
| 5,426,855 | A | * | 6/1995 | Keklak et al. | 30/125 |
| 5,613,300 | A | * | 3/1997 | Schmidt | 30/125 |
| 5,644,843 | A | * | 7/1997 | Young | 30/124 |
| 6,026,575 | A | | 2/2000 | Wonderley | |
| 6,550,144 | B1 | | 4/2003 | Berns | |
| 6,574,872 | B2 | * | 6/2003 | Roberts et al. | 30/330 |

* cited by examiner

*Primary Examiner*—Stephen Choi
(74) *Attorney, Agent, or Firm*—Christie, Parker & Hale, LLP

(57) ABSTRACT

A replaceable-blade knife useful as a carpet knife or utility knife, and having a handle with a spare-blade holder movably mounted therein, and a blade-clamping bar for securing an active cutting blade at one end of the handle. A locking means is provided to lock the holder in a protective closed position, and alternatively to release the holder to an open position by movement of the bar, and to enable ready access to blades in the holder.

6 Claims, 4 Drawing Sheets

REPLACEABLE-BLADE KNIFE

CROSS-REFERENCE TO RELATED APPLICATION

This application claims the benefit of U.S. Provisional Application 60/410,525, filed Sep. 13, 2002.

BACKGROUND OF THE INVENTION

Replaceable-blade knives such as utility knives using trapezoidal blades, and carpet knives using rectangular blades, enable use of a comfortable and contoured gripping handle with replaceable blades appropriate to the material to be cut. Storage of replacement blades in a drop-down compartment positioned within the gripping handle is disclosed in U.S. Pat. Nos. 3,577,637, 3,593,417, and 3,927,473. These prior-art arrangements, however, are somewhat inconvenient to use, as multiple steps are required to release a dull blade for replacement, and to release the holder for access to a new blade.

The invention herein disclosed is directed to a knife of this general type, and in which a drop-down blade holder is unlatched and released by movement of a blade clamp to a position enabling removal of a dull blade, and immediate installation of a replacement blade.

SUMMARY OF THE INVENTION

A replaceable-blade knife having a handle housing a spare-blade holder which is movable between open and closed positions. An active-blade clamping bar is movably mounted on the handle to be movable between a closed position in which a blade projecting from the handle is rigidly secured to the handle, and an open position enabling access to the blade. A locking means operative between the clamping bar and spare-blade holder locks the holder in its closed position when the clamping bar is in its closed position, and releases the holder for movement to its open position when the bar is in its open position.

DETAILED DESCRIPTION OF THE PREFERRED EMBODIMENT

Figure 1:
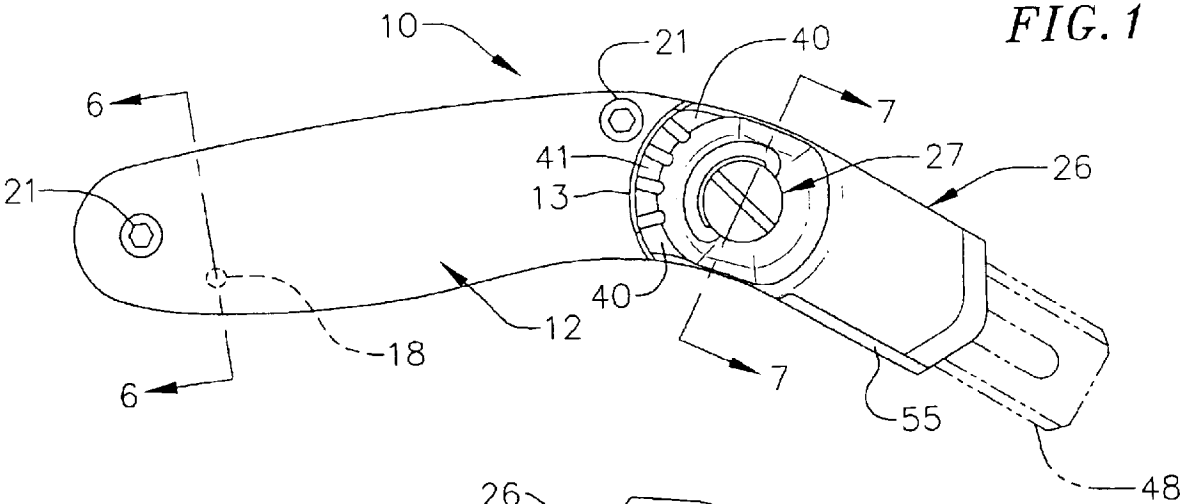
FIG. 1 is a top view of a knife according to the invention in a closed position with a blade (shown in phantom line) clamped in a cutting position.
Figure 2:
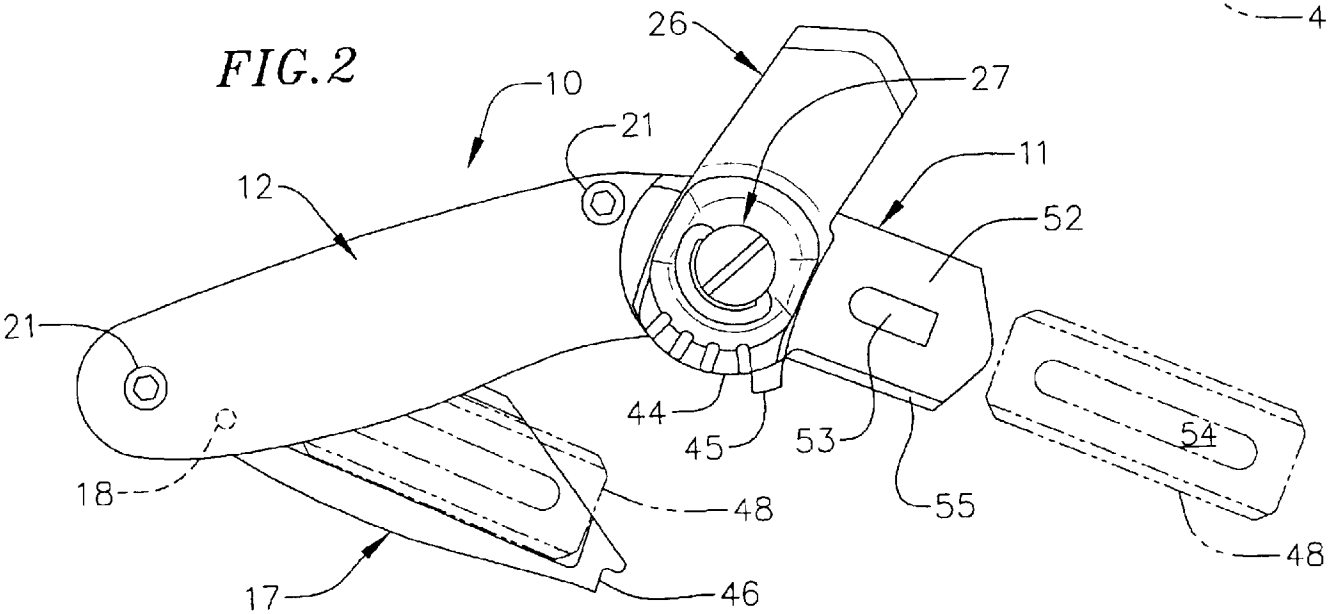
FIG. 2 is a top view showing the knife in an open position which releases the active blade, and provides access to a spare-blade holder.

A replaceable-blade knife assembly 10 according to the invention is shown in FIGS. 1–7. The assembly includes a lower body portion 11 which extends for the assembly full length, and a shorter upper body portion 12 with a concave front surface 13. The body portions have recesses 14 and 15 to receive a spare-blade holder 17 which is pivotally mounted on a pin 18 rigidly secured to portion 11, and extending through a clearance bore 19 in the rear end of the holder. The body portions are secured together by fasteners such as a pair of spaced-apart screws 21 seated in recessed openings 22 in the upper body portion, and secured in threaded openings 23 in the lower body portion. The thus-assembled rounded-edge body portions form a handle for gripping by the hand of the knife user.

Figure 3:
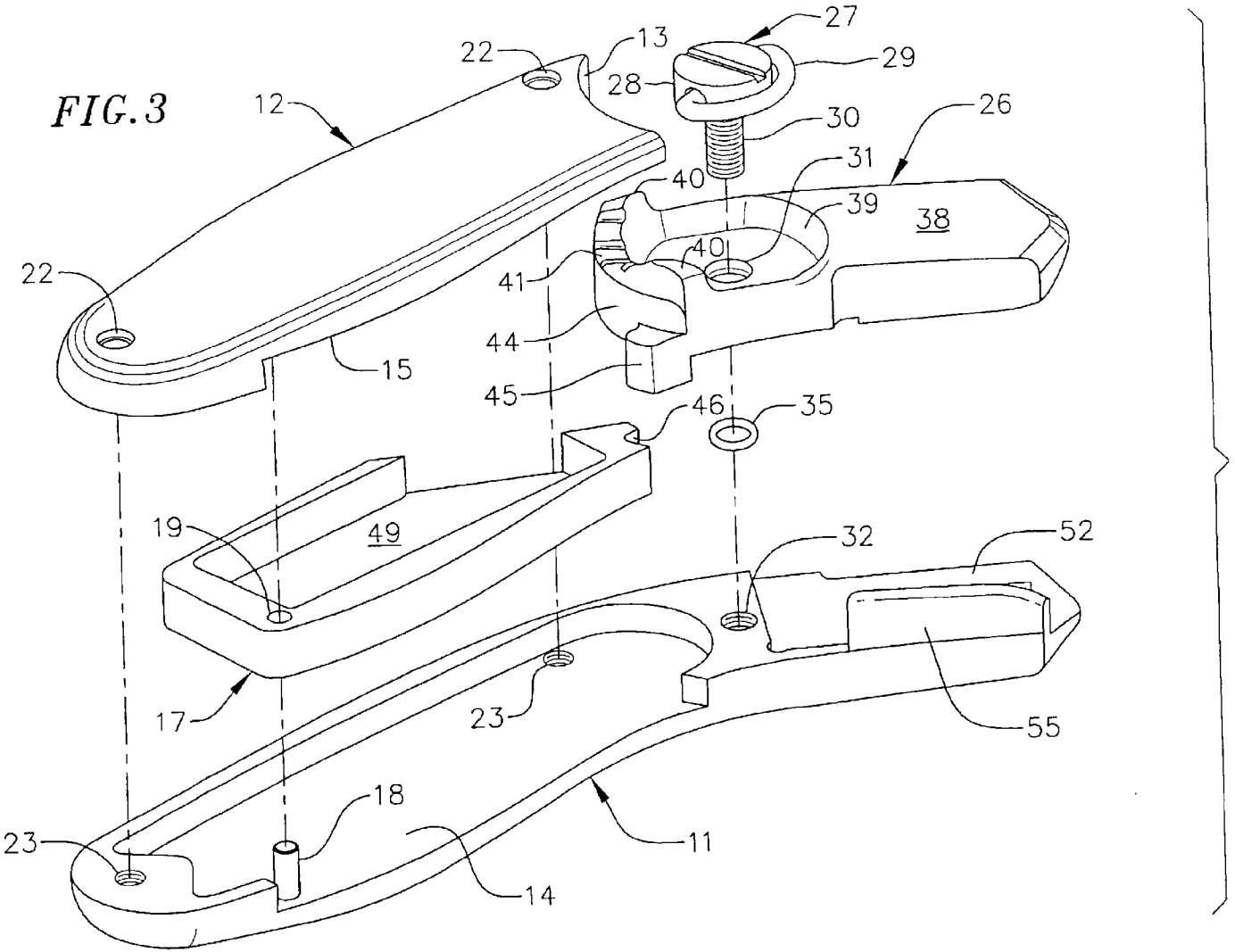
FIG. 3 is an exploded perspective view of the components of the knife.
Figure 4:
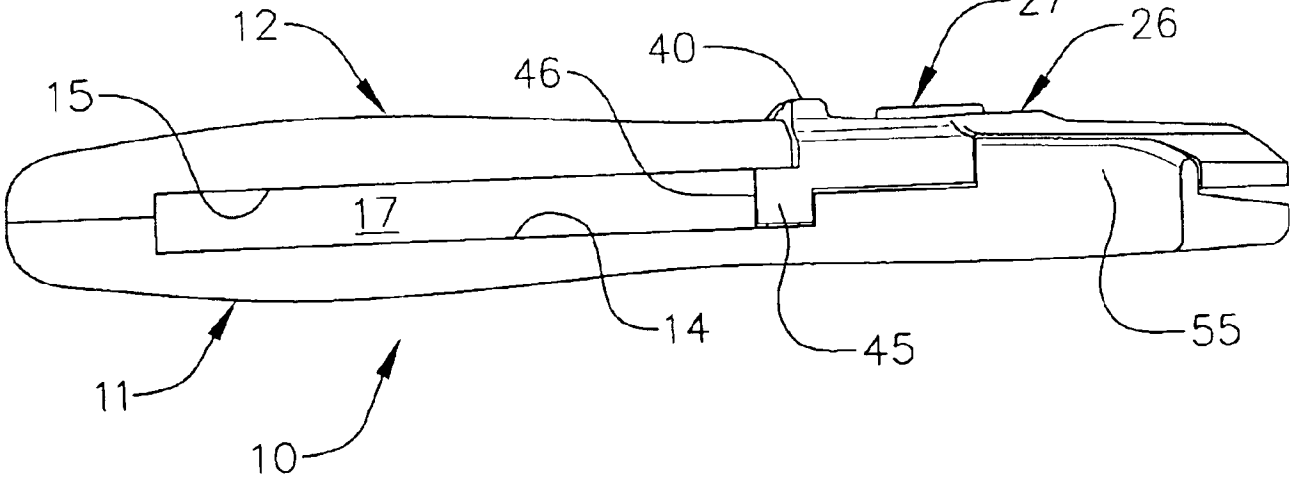
FIG. 4 is a side view taken from beneath FIG. 1.
Figure 5:
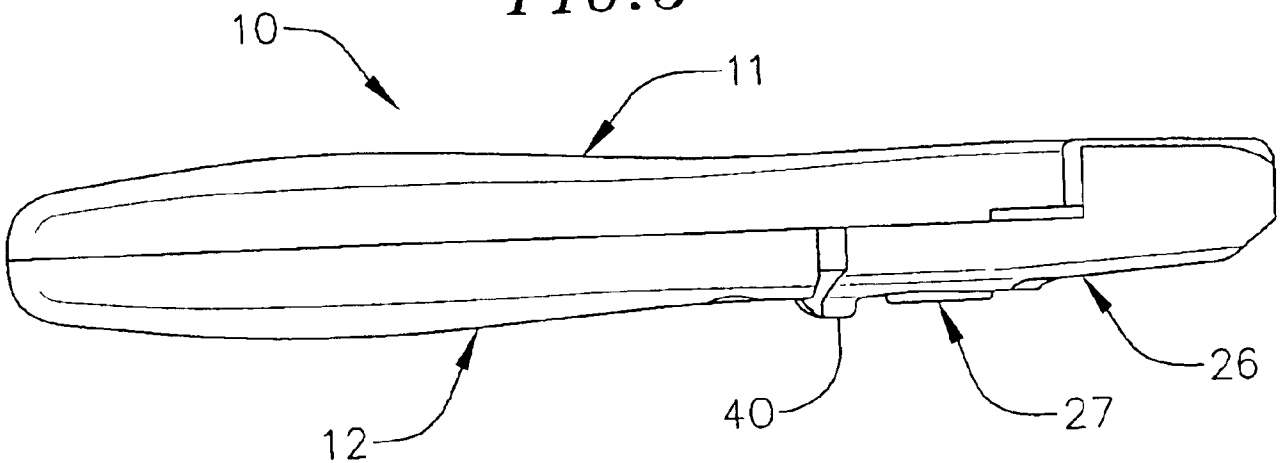
FIG. 5 is an opposite side view taken from above FIG. 1.
Figure 7:
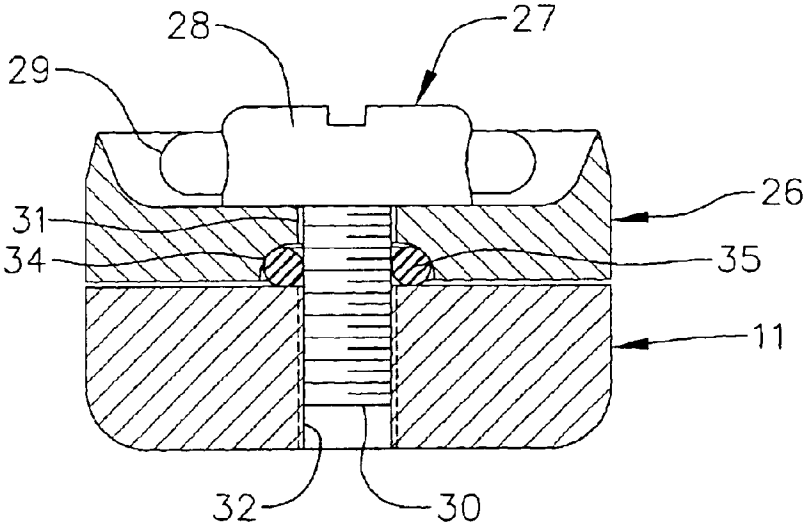
FIG. 7 is a sectional view on line 7—7 of FIG. 1.
Figure 6:
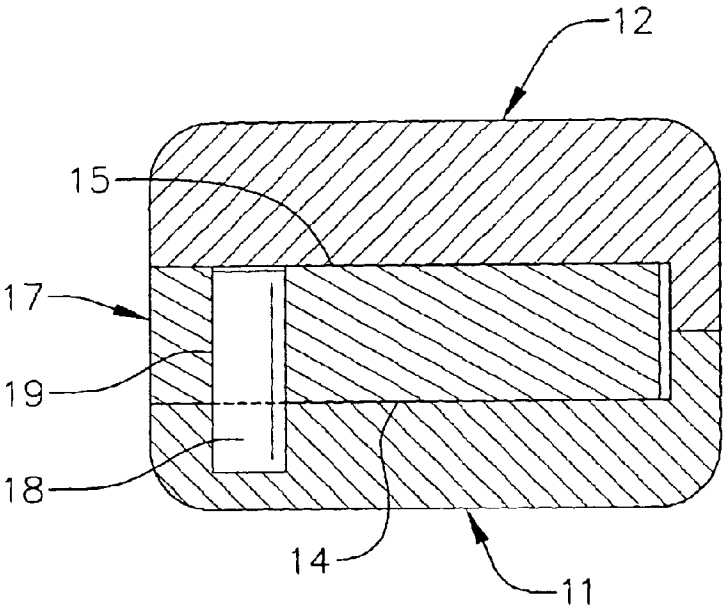
FIG. 6 is a sectional view on line 6—6 of FIG. 1.

A blade-clamping bar 26 is pivotally mounted on lower body portion 11 by a clamping screw 27 having an enlarged slotted head 28, and a pivoted D-ring handle 29 (FIG. 3). A threaded shank 30 of screw 27 passes through a clearance opening 31 in bar 26 into engagement with a threaded opening 32 in the lower body portion. An undersurface of bar 26 has a recess 34 around clearance opening 31 in which is fitted an elastomeric O-ring 35 (FIG. 7). An upper surface 38 of bar 26 has recess 39 to receive the screw head and folded D-ring handle when the screw is tightened. An upper rear end of bar 26 has raised portions 40 separated by a downwardly concave notched surface 41 for engagement with the user's finger.

Extending rearwardly and downwardly from one side of a convex rear surface 44 of bar 26 is a clamping lug 45 which fits into and against a recessed seat 46 at a forward end of space-blade holder 17. When the knife assembly is in a closed position as shown in FIG. 1, lug 45 rests against seat 46 to form a locking means for securing holder 17 in a closed position supporting one or more spare blades 48 (shown in phantom line in the drawing) seated in a protective recess 49 in the holder.

Lug 45 and seat 46 comprise a presently preferred form of a locking means operative between the spare-blade holder and blade-clamping bar. The lug and seat can be reversed (lug on holder, and seat on bar), though this arrangement would force the holder open whenever the bar is rotated to the open position.

Another blade 48 in an active cutting position (FIG. 1) is positioned against a flat and recessed front surface 52 of lower body portion 11. Surface 52 has an upstanding rib 53 which is received in a conventional central slot 54 in the blade. With bar 26 in a closed position against an upstanding wall 55 along one side of surface 52, and above the outwardly projecting active blade (FIG. 1), screw 27 is tightened to clamp the active blade tightly between surface 52 and the undersurface of bar 26, and to compress O-ring 31.

When the cutting edge of the active blade is dull, clamp screw 27 is unthreaded several turns, and expanding O-ring 31 forces the bar 26 upwardly so it can be rotated counter-clockwise to an open position (FIG. 2) enabling the blade to be reversed or turned end-for-end to position a fresh cutting edge. Rotation of the bar is facilitated by thumb-engaging recess 39. When all cutting edges of the blade are dull, the blade is discarded, and spare-blade holder 17, now out of engagement with clamping lug 45, is dropped or shaken into an open position to give the user access to a spare blade for use in the active-blade position.

What is claimed is:

1. A replaceable-blade knife, comprising:

upper and lower body portions forming a knife handle, the portions being secured together to define a recess therebetween, the lower body portion having an extended front surface configured to receive a cutting blade;

a blade-clamping bar mounted on the lower body portion adjacent the upper body portion, and movable between a closed position over the cutting blade, and an open position in which the cutting blade can be removed, repositioned, or replaced;

clamping means for tightly securing the blade-clamping bar in the closed position against the cutting blade, the clamping means being releaseable to enable the bar to be moved to the open position;

a spare-blade holder mounted in the recess between the upper and lower body portions, and adapted to hold spare cutting blades, the holder being movable between a closed position in which the spare blades are protectively concealed within the handle, and an open position in which the spare blades are accessible for removal or replacement;

locking means on the spare-blade holder and an adjacent position of the blade-clamping bar for locking the holder in the closed position when the bar is in its closed position, and releasing the holder for movement to its open position when the bar is in its open position.

2. The knife of claim 1, in which the locking means comprises a lug on the blade-clamping bar and extending toward an adjacent portion of the spare-blade holder, and a recessed seat on the holder which receives the lug when the bar and holder are in closed positions to lock the holder in the closed position, the lug moving away from the seat when the bar is moved to the open position to enable movement of the holder to an open position.

3. The knife of claim 2, in which the clamping means is a threaded fastener with an enlarged head bearing on the blade-clamping bar, and threaded into the extended front surface of the lower body portion.

4. The knife of claim 3, in which a resilient O-ring is positioned around a shank of the fastener in a recess beneath the clamping bar, and is compressed when the fastener is tightened, the compressed O-ring urging the blade-clamping bar and lower body position apart when the fastener is loosened.

5. The knife of claim 4, in which the threaded fastener has enlarged head fitting in a recess in the clamping bar, the enlarged head including a D-ring handle.

6. The knife of claim 5 in which the blade is configured for cutting carpet.

* * * * *